US007127855B1

(12) United States Patent
Garvey

(10) Patent No.: US 7,127,855 B1
(45) Date of Patent: Oct. 31, 2006

(54) TEMPERATURE RESPONSIVE ROOF VENT

(76) Inventor: Christopher Blaise Garvey, 16 Nicoll Ave., Amityville, NY (US) 11701-3018

( * ) Notice: Subject to any disclaimer, the term of this patent is extended or adjusted under 35 U.S.C. 154(b) by 80 days.

(21) Appl. No.: 10/878,253

(22) Filed: Jun. 28, 2004

Related U.S. Application Data

(60) Provisional application No. 60/482,879, filed on Jun. 26, 2003.

(51) Int. Cl.
*E04B 7/16* (2006.01)

(52) U.S. Cl. ..... 52/198; 52/72; 52/1

(58) Field of Classification Search ..... 52/72, 52/71, 198, 1
See application file for complete search history.

(56) References Cited

U.S. PATENT DOCUMENTS

| | | | | |
|---|---|---|---|---|
| 1,211,053 | A * | 1/1917 | Bernard | 160/92 |
| 2,827,003 | A * | 3/1958 | Stetson | 52/72 |
| 2,875,710 | A * | 3/1959 | Bechtold | 52/72 |
| 3,399,500 | A * | 9/1968 | Shapiro | 52/1 |
| 3,557,497 | A * | 1/1971 | Schafer | 52/1 |
| 3,728,956 | A * | 4/1973 | Field | 454/357 |
| 4,986,039 | A * | 1/1991 | Weisner | 52/72 |
| 5,147,244 | A * | 9/1992 | Spilde | 454/364 |
| 6,904,725 | B1 * | 6/2005 | Hansen et al. | 52/200 |

OTHER PUBLICATIONS 1964 greenhouse vent lifter; 2002 or before: Bayliss MK7 Auto Vent Opener. Author: Bayliss Autovents. Of the units described on the web pages, I suspect only the Bayliss MK7 Auto Vent Opener predates my application. <http://www.clearwater.org/news/deck2002.html> web pages downloaded Oct. 19, 2004.

1969 or 1790? Butterfly Skylight Hatch on 1969 built stoop *Clearwater*, the design of which was copied from traditional vessel designs perhaps two centuries old. Author: traditional design author unknown <http://www.clearwater.org/news/deck2002.html>2 photos and plan downloaded Oct. 19, 2004.

1986 Honda Civic Si automobile; Author: designed by Honda Motor Company photo Downloaded Oct. 19, 2004 from : <http://www.geocities.com/teamsdxracing/jamesw.htm>.

* cited by examiner

*Primary Examiner*—Basil Katcheves
(74) *Attorney, Agent, or Firm*—Christopher B. Garvey

(57) ABSTRACT

A vent for a roof, said vent 2 includes a box 4, shaped to be a somewhat vertical chimney, in order to maximize an upward hot air flow out of the vent. The box has an upper rim and the rim has sides. A translucent hatch extends beyond the rim to provide overhangs of several inches and thereby provide rain protection at the rim when the hatch is open. A hinge allows lifting the hatch at all sides of the rim, to allow a breeze from any direction to venturi air from the chimney, without creating an air-scoop that would cause a downdraft, which downdraft would counteract the upward hot air flow. Above a preset temperature, a heat-actuated lifter lifts the hatch. The lifter increases the lift distance at higher temperatures, and decreases the lift distance at lower temperatures. The lifter closes the hatch below the pre-set temperature. The translucent hatch admits light, and inside surfaces of the box transmit that light by reflection to a space below.

10 Claims, 7 Drawing Sheets

TEMPERATURE RESPONSIVE ROOF VENT

CROSS-REFERENCES TO RELATED APPLICATIONS

This application claims benefit of Provisional Application 60/482,879 filed Jun. 26, 2003.

STATEMENT AS TO RIGHTS TO INVENTIONS MADE UNDER FEDERALLY-SPONSORED RESEARCH AND DEVELOPMENT (IF ANY)

None.

BACKGROUND OF THE INVENTION

1. Field of the Invention

The present invention relates to the field of roof vents and skylights for residential and commercial spaces.

2. Description of Related Art Including Information Disclosed Under 37 CFR 1.97 and 1.98.

Greenhouses have long used expanding wax-operated temperature-sensitive vents to control the greenhouse temperature. These are powered by thermal expansion and don't require electrical power. But greenhouses are not damaged by the entry of rain or insects into an open roof. Residential and Commercial spaces are sensitive to water damage. An unscreened automatic vent that does not close in response to rain has not seemed like a good idea for a residence or business.

SUMMARY OF THE INVENTION

The present invention is a roof vent which admits sun and moon light, requires no power hookup, closes in response to low temperature, admits solar heat in cool weather, opens in response to high temperature, ventilates by thermally induced convection, is screened against insects and animals, but does not admit rain to a residential or commercial space, and does not act as an air scoop, no matter what the wind direction.

DESCRIPTION OF THE PREFERRED EMBODIMENT(S)

Figure 1:
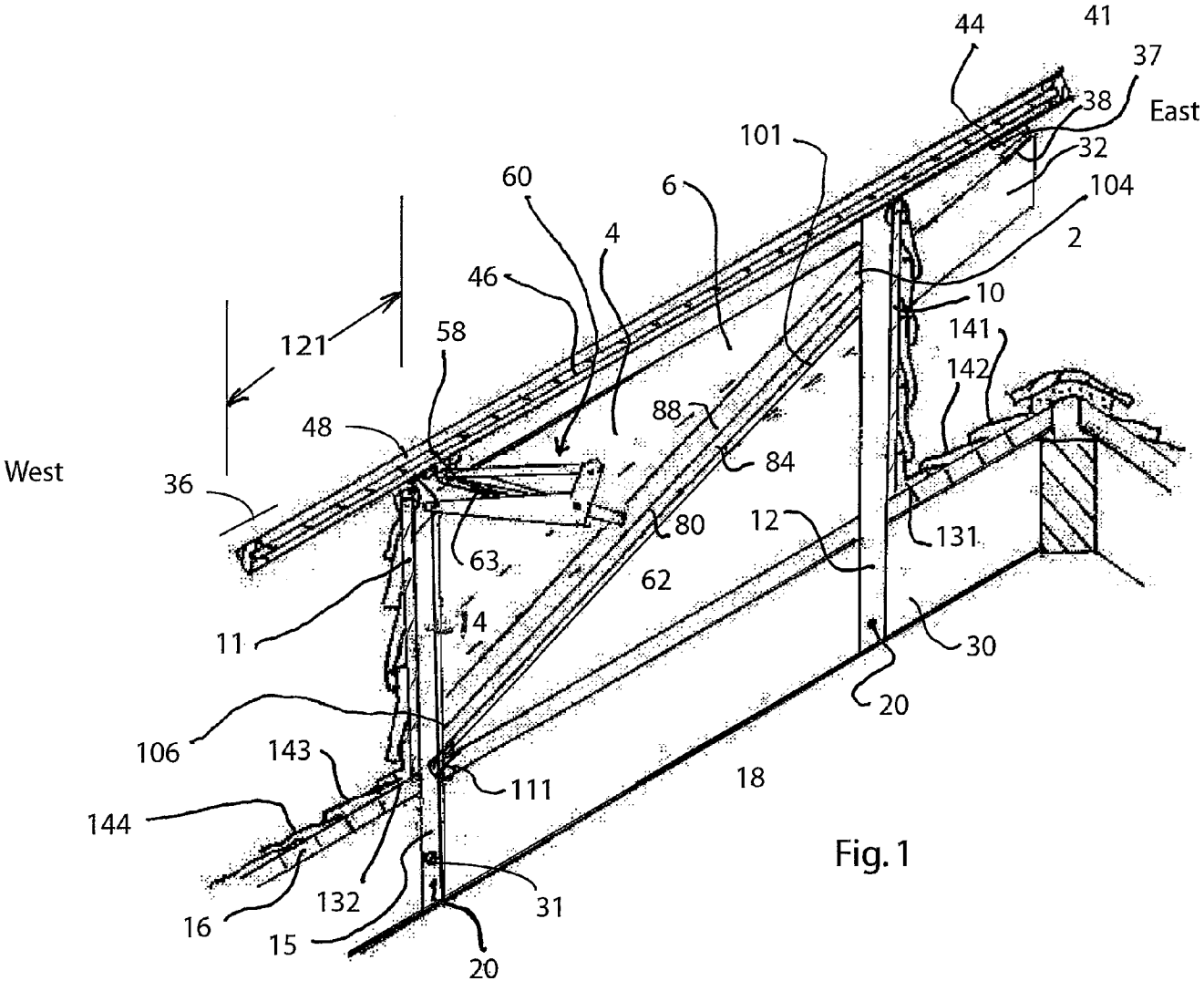
FIG. 1 is a side elevation of the vent, in section through its centerline shown as plane 1 in FIG. 3.
Figure 3:
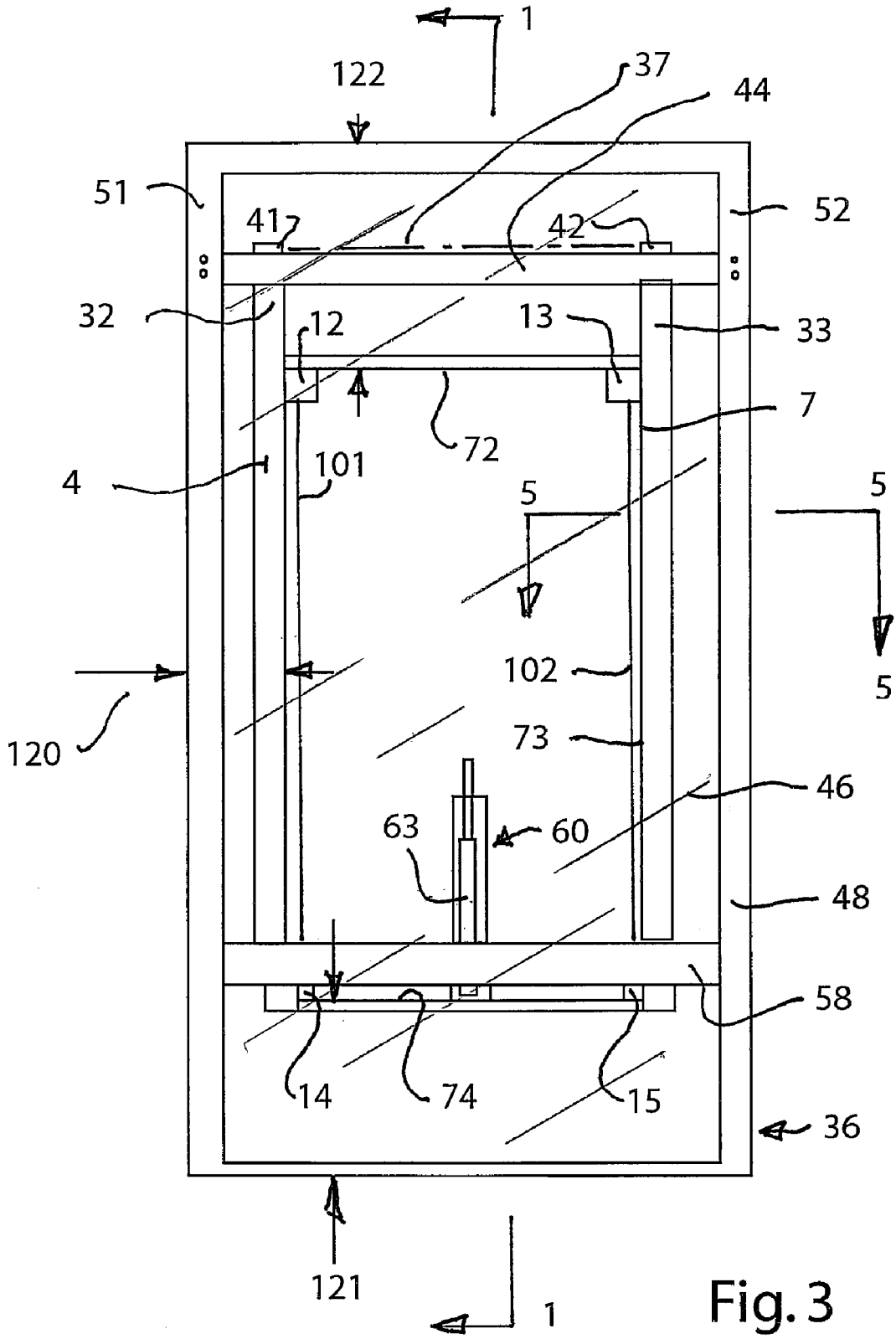
FIG. 3 is a plan view.

FIG. 1 is a side elevation of the vent, generally designated 2, in section through its centerline shown as plane 1 in FIG. 3.

The vent 2 comprises a box 4, may be made of sheet metal or plastic, as manufacturing exigencies dictate, but the prototype is made of wood and has worked very well during its 23 month test period. Box 4 comprises a parallelogram wall 6, made of half inch exterior grade plywood, and its opposite wall 7 (FIG. 3), and an upper end wall 10, and lower end wall 11 (FIGS. 1 & 3). These are joined together by applying a sealant glue or caulking at their joints and screwing and glueing them to 2×2 verticals 12–15.

Box 4 is shaped to be a vertical chimney, in order to maximize hot air flow out of the vent, but it may alternatively be made perpendicular to the root in order to avoid custom angles in mass production, presumably without too much loss of flue draft effect. Or, a plurality of production versions or adapters can be made allow an installer to approximate a vertical flue in a variety of roof angles.

The prototype was installed during replacement of the roof shingles, which simplified installation. A hole 18 was cut in roof sheathing 16, big enough to permit entry of the verticals 12–15, but too small to admit the plywood sides 6–7, and ends 10–11. The plywood of the box thus rests upon sheathing 16. With the box in place, screws 20 attached the verticals of the box to rafter 30 and it's opposite side counterpart rafter.

The prototype box was sized to fit the verticals snugly to rafters at both sides.

Rung 31, provides support for a ladder, or for a person to hold while standing on a step ladder, to service or observe the vent.

Hinge supports 32–33 are glued and screwed to sides 6–7 and extend beyond end 10 at such an angle to hinge the hatch 36 at a pivot line 37 remote from the box 4. Crosspiece 38 spans hinge supports 32–33. Hinges 41–2 are affixed to 2×½ crosspiece 38 as by wood or machine screws. Hinge strut 44 is similarly mounted atop hinges 41–2.

In cold climates, I prefer hatch 36 to close with sufficient slope to shed snow.

Hatch 36 comprises a glass pane 46, and an aluminum frame 48.

The inventor contemplated using a double pane insulated glass, but settled on a discarded sliding shower door. This has proved so far to be a good choice from the standpoint of strength and durability. Heat need not be insulated against because the hatch opens at a preset temperature, and hot air in the chimney may actually improve airflow and ventilation to cool the underlying attic. On cold days, the sun will add heat through the glass until the lift temperature is exceeded. Only on cold nights is the lack of insulating glass a factor. In the prototype's house the attic is unheated, and the attic floor is insulated from the living area below. In a finished attic insulated glass may be used, but I prefer not to add a heat radiation reflective coating.

Hinge strut 44 spans rails 51–2 of frame 48 and is affixed thereto by machine or wood screws. Lift strut 58, a 2×½ wood strut, also spans rails 51 and 52 at the other end of the box 4.

Figure 2:
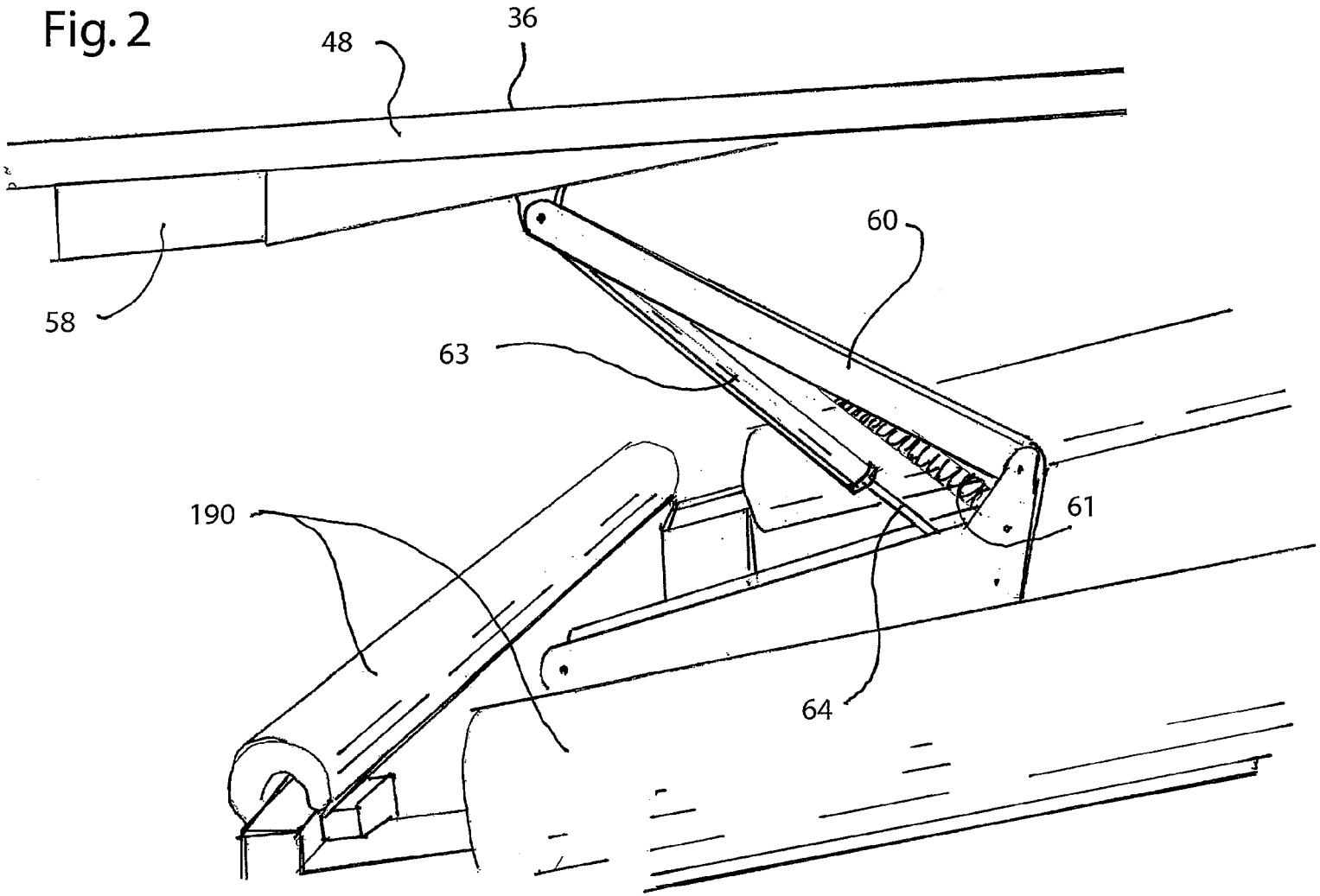
FIG. 2 is a side elevation of the vent opener, showing part of FIG. 1, but not in section.

A greenhouse vent lifter 60 is mounted at the top of end 11 to lift strut 58. The prototype employs a Bayliss MK7 (presumed to be trademarked) Auto Vent Opener. The MK7 has a 16 lb. lifting capacity and a large return spring 61 FIG. 2 to help prevent wind damage. Opening temperature can be adjusted from 55° F. to 75° F. and maximum opening of 12" is reached at approximately 20° F. above opening temperature. Adjuster screw 62 FIG. 1, adjusts the opening temperature as in the directions provided by the manufacturer. The Bayliss MK7 is made from corrosion resistant materials: stainless steel, anodized aluminum, and brass. With appropriate adjustment, it may be possible to use other makes and models, but the Bayliss MK7 works in this application.

This vent opener uses a very simple principle—Special waxes have an expansion rate of about 18% when heated by the sun. As the air in the greenhouse heats up it also heats the power tube 63 (FIG. 2) in the vent opener 60. As the wax expands it pushes out a stainless steel piston 64 that slowly opens the vent hatch 36 up to 13 inches. The hotter the temperature the wider the opening. When the temperature cools, the weight of the vent hatch 36 and a 6½ pound stainless steel spring 61 closes the vent and holds it closed.

Figure 6:
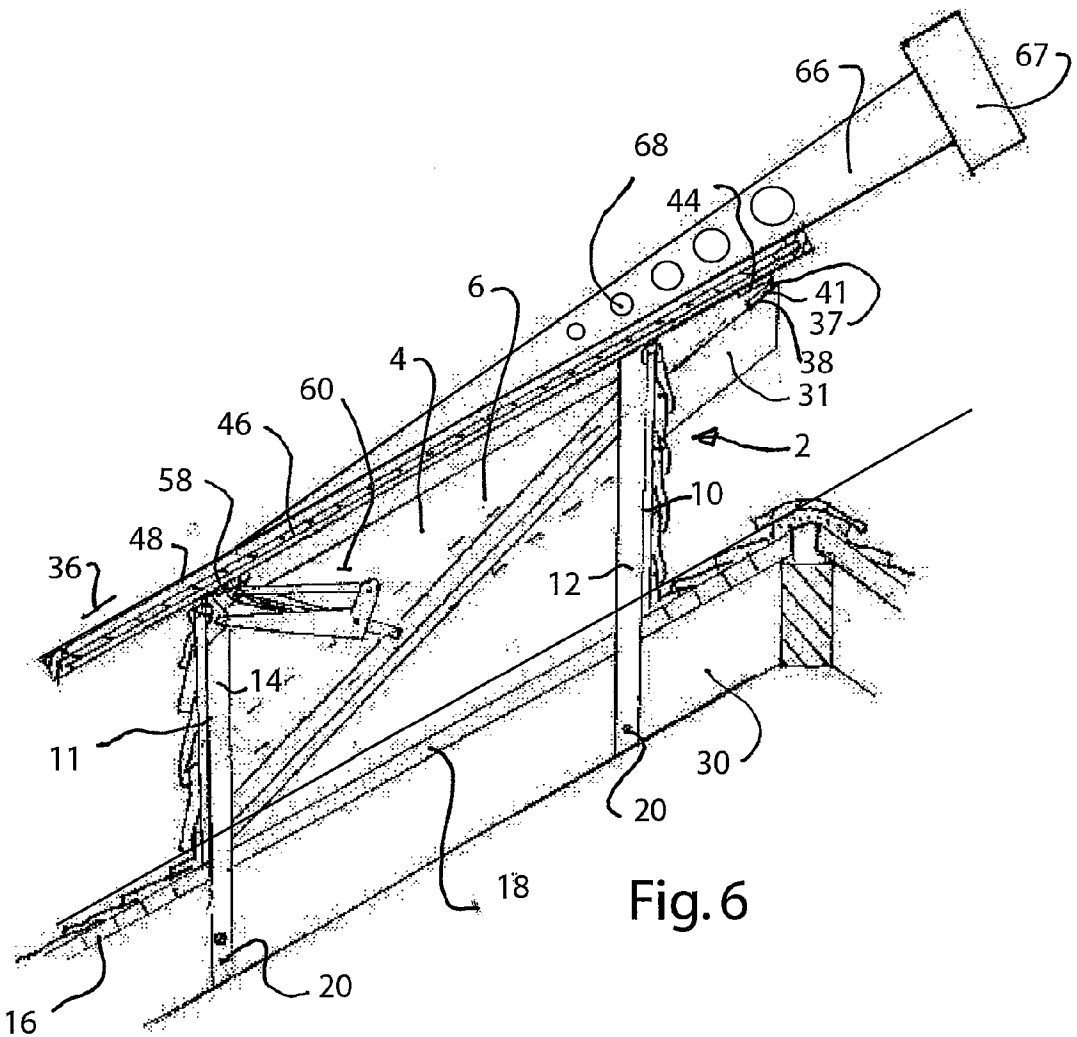
FIG. 6 is a side elevation, similar to FIG. 1, of an alternate embodiment.

As in FIG. 6, the inventor planned to extend counterweight struts 66 from frame rails 51–2 above the pivot line 37 of hinges 41–2, to assist the lifter, but this proved to be unnecessary in this installation. With a larger hatch or weaker lifter, counterweights 67 may be used. The part of strut 66 below pivot line 37 that reinforces rail 52 should be lightened as by holes 68.

To maximize cooling, the vent should be installed at the roof peak. The prototype was installed slightly below the peak, to provide more room to install flashing, and to allow a conventional ridge vent on the roof.

The inside surfaces 71–4 of box 4 are painted white to provide maximum solar illumination to the attic without the excessive glare that might result from mirrored surfaces. But mirrored or silvered surfaces will alternatively provide light too.

Figure 7:
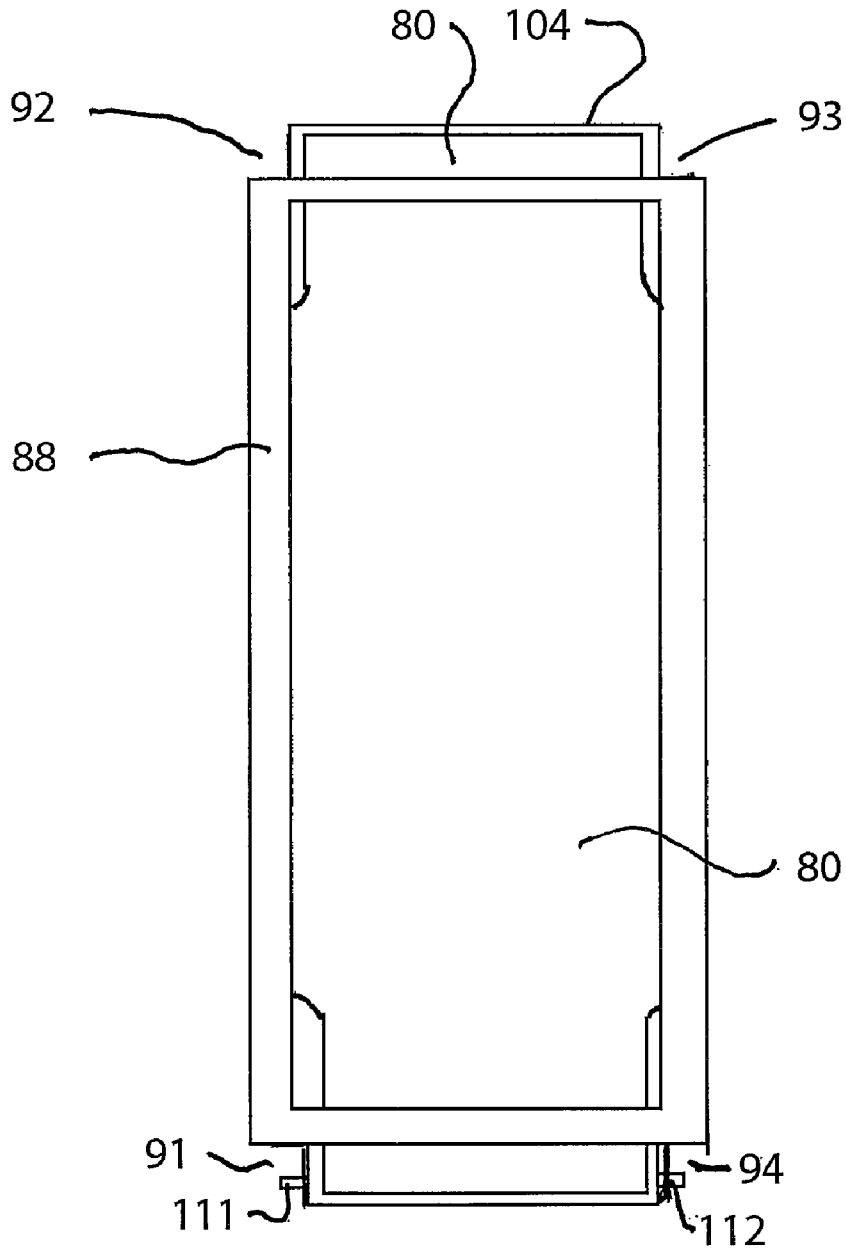
FIG. 7 is a plan view of the screen.

A screen 80 is provided to keep out insects and birds. Pet-proof heavy duty plastic screening is used, with a hope of discouraging raccoons. So far, none have entered. For the prototype, a wooden framework 88–89 sandwiches screen 80 in FIG. 1. FIG. 7 shows a plan view of the screen 80 and frame top 88. Notches 91–94 are defined in order to fit around verticals 12–15. Rails 101 (FIGS. 1 & 3) and 102 (FIG. 3) were intended as drip rails, but this has thus far proven unnecessary even in torrential wind-blown rain. They thus serve primarily as a screen guide. To install the screen, slide end 104 with notches 92–93 along rails 101–102, until end 104 abuts surface 72 of box end 10. Then pivot screen end 106 to surface 74 of box end 11 and latch slide-bolts 111–2 into receiving holes in verticals 14–15. The screen remains in place because the length between screen end 104 and end 106 is greater than the length of the box.

The 19" vertical of the box has several advantages. It provides a flue effect to increase ventilation by upward convection of hot attic air. It spaces the top vent opening above the root so that rain spattering on the roof doesn't spatter into the opening. It also provides space for the vent opener 60 to pivot in the box 4 without impinging on the screen 80. It transmits light by diffuse reflection of the white paint, while shading the attic interior and its contents from some direct sunlight and glare. The box may be made somewhat taller, for increased flu effect, but excessive height may reduce light transmission to the attic unless the inner surface of the box is mirrored.

The overhangs of hatch 36 over box 4 are critical to the performance of the vent in keeping rain out. Smaller overhangs might work, but I know that these overhangs are adequate to keep out rain in all storms thus far during almost two years of experimental use. Side overhangs 120 are 5". Bottom overhang 121 is 11". Top overhang 122 is 12". In practice, when rain clouds block the sun, the opener 60 retracts from its full extension and reduces the opening to a few inches. In a strong wind driven rain from the East, I was barely able to feel a small quantity of atomized mist beneath the hatch. As I strained to detect some spray from the opening, I turned to notice that the attic's East windows were admitting a large quantity of rain, despite an overhanging root and that a mop was needed at those windows.

Figure 4:
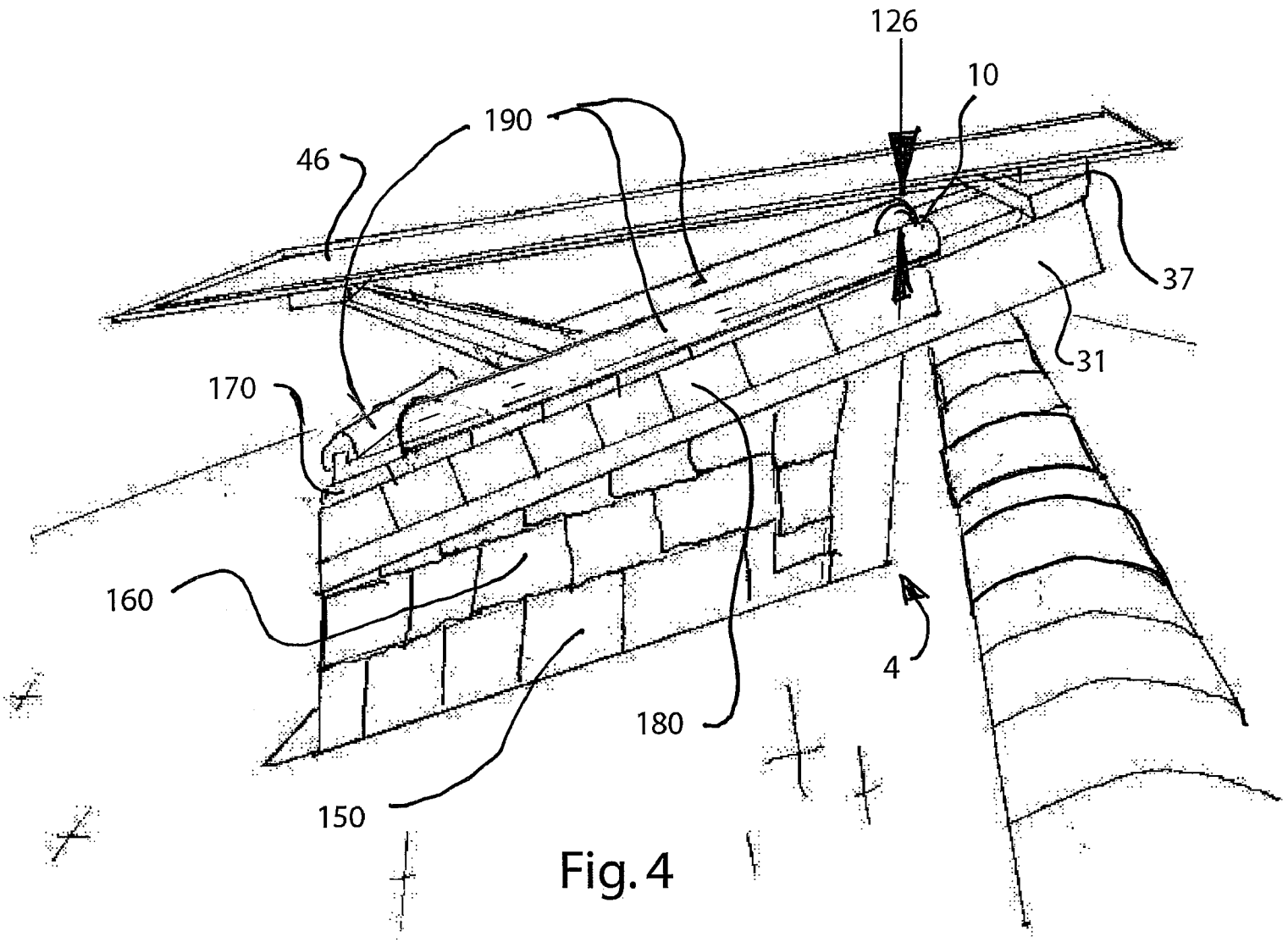
FIG. 4 is a side elevation similar to FIG. 1, but not in section.

Because the hinge pivot line 37 is spaced from the box edge 10, as shown in FIG. 4 when the hatch 36 is open, there is a gap at all sides, such as gap 126, between vent 4 and glass 46. Thus, there is no wind direction from which the wind is scooped by the glass down the hatch to fight the updraft of hot air from the attic. From all directions the wind passes unimpeded across the bottom of glass 46 and sweeps away the hot air rising from box 4 with a low pressure venturi effect.

Other types of hinging that lift all sides of a lid may also be appropriate, and may even be more aesthetically pleasing than the prototype embodiment.

Figure 5:
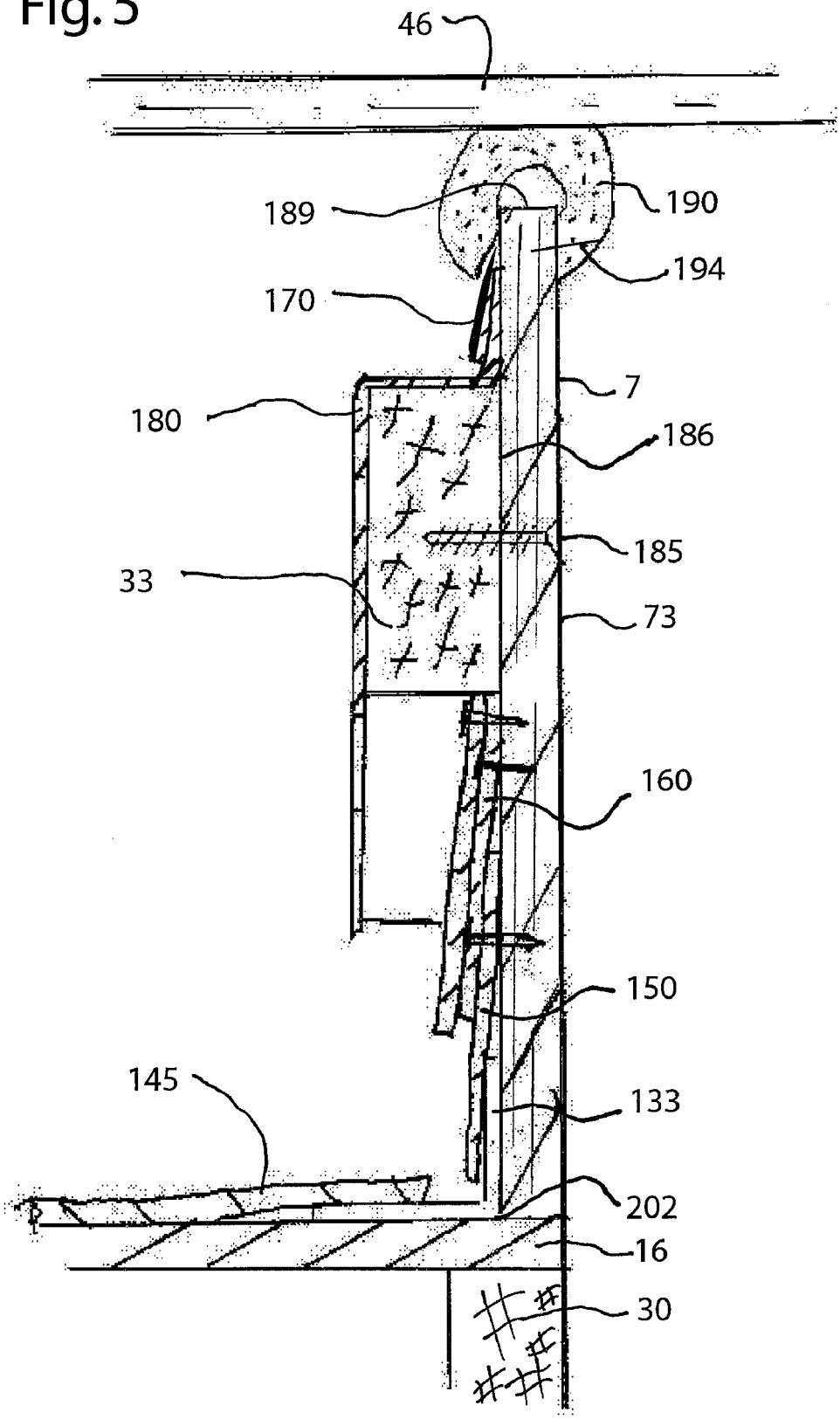
FIG. 5 is an elevation, taken in section through plane 5 of FIG. 3.

As in FIGS. 1 & 5, for waterproofing of the box 4, aluminum flashing 131, 132, 133 is interleaved around all sides at the base of box 4, with the roof shingles 141–144. At the bottom of the box flashing 132 overlies shingle 143. Installation and interleaving is particularly easy if the box is installed at the same time as new replacement roof shingles.

Otherwise the existing shingles can be temporarily pealed back from the hole 18 cut in the roof to interleave the flashing 131–133.

FIG. 4 shows shingles 150, 160, nailed onto the box 4 over the there hidden flashing 131–133, to complete the water shedding of the box at it's base.

FIG. 5 sections through plane 5 in FIG. 3, not to scale. For shedding rain, flashing 180 covers hinge support strut 33: Strut 33 is screwed 185 and caulked 186 for further water resistance, to plywood side 7. Shingle 170 further covers the box 4 and the top of flashing 180.

Top edge 189 of side 7, and the top edges of the other sides, are covered by a ¾ inch wall thickness split foam pipe insulation 190. This is affixed by the adhesive that is supplied at the split, then mechanically fastened as by a screws such as 194 to inside 73 and the outside of plywood side 7. Foam 190 gaskets between the edge 189 and glass 46 to seal against cold drafts when closed, and to cushion the closing of the glass against the edge, and distribute loads, thus protecting the glass. Foam 190 also protects top plywood edge 189 from weather, although the hatch 36 provides most of that protection already. Other sealing arrangements, such as a top-edge-mounted O-ring are also contemplated. Such O-rings are conventionally used to seal storm doors against air leakage when the doors are closed.

Step flashing 133 underlies roof shingles 145 and box shingles 150. Shingles 150 underlie shingles 160 to shed water from the box-roof corner 202.

Temperature measurements have confirmed my sense impression that the vent worked as intended to reduce the attic temperatures. Blocking the functioning vent, by covering the screen 80 with opaque air-flow-blocking plastic sheet, immediately results in a dark, gloomy and stuffy feeling attic. Shortly after such a blockage, the attic temperatures rose.

The prototype shown and described is the presently preferred embodiment, because it has shown itself to work as intended. Other embodiments are also contemplated, without departing from the invention.

I claim:

1. A vent for a roof, said vent (2) comprises:

a box (4) shaped to be a substantially vertical chimney, in order to maximize an upward hot air flow out of the vent;

said box having an upper box rim, said uppper box rim having sides;

a translucent hatch, which extends beyond said upper box rim to provide overhangs of several inches and thereby provide rain protection at the upper box rim when said hatch is open;

a hinge;

said hinge having a pivot line (37); said pivot line located outside and distal from the upper box rim, for lifting said hatch at all sides of said upper box rim, to allow a breeze from any direction to venturi air from the chimney, without creating an air-scoop that would cause a downdraft, which downdraft would counteract the upward hot air flow;

a heat-actuated lifter, for lifting the hatch above a preset temperature, for increasing a distance of lift at higher temperatures, for decreasing the lift distance at lower temperatures, and for closing said hatch below said pre-set temperature.

2. A vent according to claim 1 in which a screen for excluding insects is located in the box, sufficiently below the upper box rim to allow the heat-actuated lifter in operation to clear the screen.

3. A vent according to claim 2 in which the screen for excluding insects is also strong enough to exclude animals.

4. A vent according to claim 1 in which the overhangs comprise:

two side overhangs of at least 5";

a bottom overhang of at least 11"; and a top overhang of at least 12".

5. A vent according to claim 1 in which all said overhangs of the hatch fully open intersect an angle greater than 23 degrees from a vertical drawn from the upper box rim.

6. A vent for a roof said vent (2) comprises:

a box (4) shaped to be a substantially vertical chimney, in order to maximize an upward hot air flow out of the vent;

said box having an upper box rim, said upper box rim having sides;

a translucent hatch, which extends beyond said upper box rim to provide overhangs of several inches and thereby provide rain protection at the upper box rim when said hatch is open;

a hinge;

said hinge having a pivot line; said pivot line located distal from the upper box rim, for lifting said hatch at all sides of said upper box rim, to allow a breeze from any direction to venturi air from the chimney, without creating an air-scoop that would cause a downdraft, which downdraft would counteract the upward hot air flow;

a heat-actuated lifter, for lifting the batch above a preset temperature, for increasing distance of lift at higher temperatures, for decreasing the lift distance at lower temperatures, and for closing said hatch below said pre-set temperature;

in which a screen for excluding insects is located in the box, sufficiently below the upper box rim to allow the heat-actuated lifter in operation to clear the screen.

7. A vent according to claim 6 in which the hinge has only one pivot line which is spaced from the upper box rim so that when the hatch is open, there is a vertical gap at all the upper box rim sides, between the upper box rim and the hatch, so that there is no wind direction from which a wind is scooped by the hatch down the flue to fight an updraft of hot air from below, so that from all directions the wind passes unimpeded across the bottom of the hatch, and said wind sweeps away the hot air rising from box, with a low pressure venturi effect.

8. A vent according to claim 6 in which all said overhangs of the hatch fully open intersect an angle greater than 23 degrees from a vertical drawn from the upper box rim.

9. A vent according to claim 8 in which the overhangs comprise:

two side overhangs of at least 5";

a bottom overhang of at least 11" and a top overhang of at least 12".

10. A vent for a roof, said vent comprises:

a box (4) shaped to be a substantially vertical chimney, in order to maximize an upward hot air flow out of the vent;

said box having an upper box rim, said upper box rim having sides;

a translucent hatch, which extends beyond said upper box rim to provide overhangs of several inches and thereby provide rain protection at the upper box rim when said hatch is open;

in which the overhangs comprise:

two side overhangs of at least 5";

a bottom overhang of at least 11"; and a top overhang of at least 12";

a hinge for lifting said hatch at all sides of said upper box rim, to allow a breeze from any direction to venturi air from the chimney, without creating an air-scoop that would cause a downdraft, which downdraft would counteract the upward hot air flow;

in which the hinge has a single pivot line (37) which is spaced from the upper box rim so that when the hatch is open, there is a vertical gap at all the upper box rim sides, between the upper box rim and the hatch, so that there is no wind direction from which a wind is scooped by the hatch down the flue to fight an updraft of hot air from below, so that from all directions the wind passes unimpeded across the bottom of the hatch, and said wind sweeps away the hot air rising from box, with a low pressure venturi effect;

a heat-actuated lifter, for lifting the hatch above a preset temperature, for increasing a distance of lift at higher temperatures, for decreasing the lift distance at lower temperatures, and for closing said hatch below said pre-set temperature;

a screen for excluding insects is located in the box, sufficiently below the upper box rim to allow the heat-actuated lifter in operation to clear the screen and the screen for excluding insects is also strong enough to exclude animals;

the hinge is outside and distal from the upper box rim, thus lifting said hatch at all sides of said upper box rim.

* * * * *